US007256677B2

(12) United States Patent
Pauley, Jr. et al.

(10) Patent No.: US 7,256,677 B2
(45) Date of Patent: Aug. 14, 2007

(54) TRANSFORMER HAVING A STACKED CORE WITH A CRUCIFORM LEG AND A METHOD OF MAKING THE SAME

(75) Inventors: William E. Pauley, Jr., Bland, VA (US); Charlie H. Sarver, Rocky Gap, VA (US); Rush B. Horton, Jr., Wytheville, VA (US)

(73) Assignee: ABB Technology AG, Zurich (CH)

( * ) Notice: Subject to any disclaimer, the term of this patent is extended or adjusted under 35 U.S.C. 154(b) by 72 days.

(21) Appl. No.: 11/093,408

(22) Filed: Mar. 30, 2005

(65) Prior Publication Data

US 2006/0226946 A1 Oct. 12, 2006

(51) Int. Cl.
*H01F 27/24* (2006.01)

(52) U.S. Cl. ..... 336/212; 336/234

(58) Field of Classification Search ..... 336/212, 336/217, 233, 234, 180, 182
See application file for complete search history.

(56) References Cited

U.S. PATENT DOCUMENTS

| | | | | |
|---|---|---|---|---|
| 2,898,565 | A | | 8/1959 | Fox et al. |
| 3,157,850 | A | | 11/1964 | Winter et al. |
| 3,270,307 | A | | 8/1966 | Jean et al. |
| 3,504,318 | A | * | 3/1970 | Hattrup et al. ..... 336/12 |
| 3,743,991 | A | * | 7/1973 | Gumpper et al. ..... 336/217 |
| 4,136,322 | A | | 1/1979 | Maezima |
| 4,200,854 | A | | 4/1980 | DeLaurentis et al. |
| 4,201,966 | A | | 5/1980 | De Laurentis |
| 4,283,842 | A | | 8/1981 | DeLaurentis et al. |
| 4,520,556 | A | | 6/1985 | Pasko, Jr. et al. |
| 4,521,957 | A | | 6/1985 | McLeod |
| 4,724,592 | A | | 2/1988 | Hunt et al. |
| 5,959,523 | A | | 9/1999 | Westberg |

FOREIGN PATENT DOCUMENTS

| | | |
|---|---|---|
| DE | 3623271 A1 | 10/1986 |
| JP | 62-026805 | 2/1987 |
| JP | 04-251903 | 9/1992 |

OTHER PUBLICATIONS

U.S. Appl. No. 11/093,551, William E. Pauley, Jr. et al.

* cited by examiner

*Primary Examiner*—Anh Mai
(74) *Attorney, Agent, or Firm*—Paul R. Katterle

(57) ABSTRACT

The present invention is directed to a transformer having a stacked core, which includes upper and lower yokes and first and second outer legs. The core also includes one or more inner legs. Each of the upper and lower yokes is formed from a stack of plates and has a rectangular cross-section. Each inner leg is formed from a stack of plates and has a cruciform cross-section. Each of the first and second outer legs is formed from a stack of plates and may have a cruciform cross-section.

20 Claims, 8 Drawing Sheets

TRANSFORMER HAVING A STACKED CORE WITH A CRUCIFORM LEG AND A METHOD OF MAKING THE SAME

FIELD OF THE INVENTION

The invention relates to transformers and more particularly, to transformers having a stacked core with a cruciform leg and methods of making the same with reduced waste.

BACKGROUND OF THE INVENTION

A stacked transformer core is comprised of thin metallic laminate plates, such as grain oriented silicon steel. This type of material is used because the grain of the steel may be groomed in certain directions to reduce the magnetic field loss. The plates are stacked on top of each other to form a plurality of layers. A stacked core is typically rectangular in shape and can have a rectangular or cruciform cross-section. A cruciform cross-section increases the strength of a stacked core. In addition, a core leg having a cruciform cross-section provides more surface area for supporting a coil. An example of a conventional stacked transformer core having a cruciform cross-section is shown in U.S. Pat. No. 4,283,842 to DeLaurentis et al. The core of the DeLaurentis et al. patent has upper and lower yokes with cruciform cross-sections, as well as legs with cruciform cross-sections.

Although a stacked core having a cruciform cross-section, such as the core of the DeLaurentis et al. patent, provides additional support and strength, such a core is typically more difficult to manufacture and results in more wasted steel. Therefore, it would be desirable to provide a stacked transformer core that has the benefits of a cruciform cross-section, but is simpler to manufacture and reduces the amount of steel that is wasted. The present invention is directed to such a transformer core and a method of making the same.

SUMMARY OF THE INVENTION

In accordance with the present invention, a transformer is provided having a stacked core. The core is provided with a first yoke formed from a stack of plates and having an outer side and an inner side with a groove formed therein. The groove extends in a stacking direction of the plates and is located inwardly from the outer side. The plates have the same width so as to provide the first yoke with a rectangular cross-section. The core is also provided with a second yoke formed from a stack of plates and having an outer side and an inner side with a groove formed therein. The groove extends in the stacking direction of the plates and is located inwardly from the outer side. A first end of an inner leg is disposed in the groove of the first yoke and a second of the inner leg is disposed in the groove of the second yoke. The inner leg has a cruciform cross-section and is formed from a stack of plates with different width. A coil winding is mounted to the inner leg.

Also provided in accordance with the present invention is a method of forming a transformer with a stacked core. In accordance with the method, a plurality of first and second outer leg plates and a plurality of inner leg plates are provided. The inner leg plates have different widths. A plurality of first yoke plates with the same width is also provided. Each of the first yoke plates has an outer side and an inner side with a notch formed therein. The notch is located inwardly from the outer side. The inner leg plates, the first yoke plates and the first and second outer leg plates are stacked to form first and second outer legs, a first yoke with a first groove, and an inner leg having a first end disposed in the first groove. The first outer leg is formed from the first outer leg plates, the second outer leg is formed from the second outer leg plates, the inner leg is formed from the inner leg plates and the first yoke is formed from the first yoke plates. The first groove extends in a stacking direction of the first yoke and is formed by the notches of the first yoke plates. The inner leg plates are stacked so as to provide the inner leg with a cruciform cross-section and the first yoke plates are stacked so as to provide the first yoke with a rectangular cross-section. A coil winding is mounted to the inner leg.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
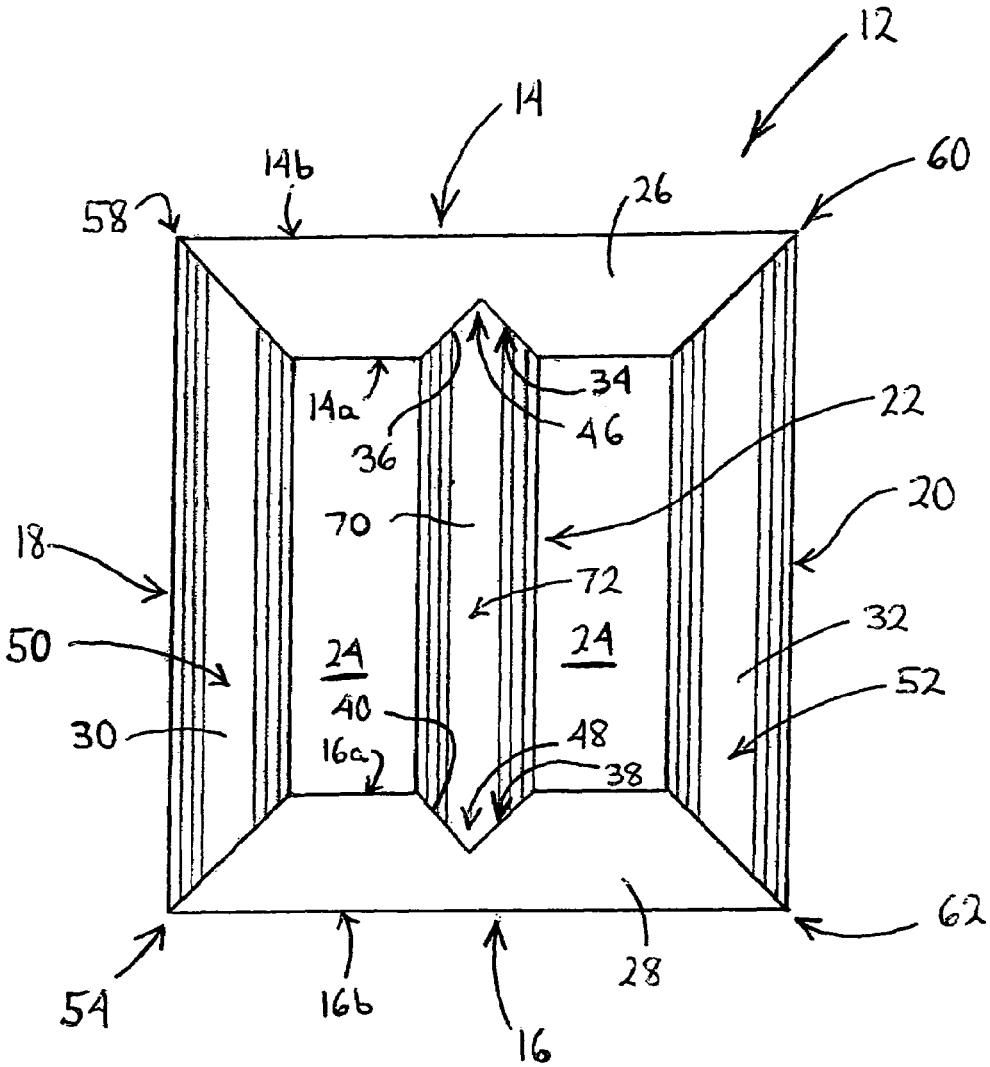
FIG. 1 shows a front elevational view of a transformer core constructed in accordance with a first embodiment of the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

The present invention is directed to a transformer 10 (shown in FIG. 6), such as a distribution transformer, having a stacked core 12. The transformer 10 may be an oil-filled transformer, i.e., cooled by oil, or a dry-type transformer, i.e., cooled by air. The construction of the core 12, however, is especially suitable for use in a dry transformer. Referring now to FIG. 1, the core 12 has a rectangular shape and generally comprises an upper yoke 14, a lower yoke 16, first and second outer legs 18, 20 and an inner leg 22. Upper ends of the first and second outer legs 18, 20 are connected to first and second ends of the upper yoke 14, respectively, while lower ends of the first and second outer legs 18, 20 are connected to first and second ends of the lower yoke 16. The inner leg 22 is disposed midway between the first and second outer legs 18, 20. The inner leg 22 has an upper end connected to the upper yoke 14 and a lower end connected to the lower yoke 16. With this construction, two windows 24 are formed between the inner leg 22 and the first and second outer legs 18, 20.

The upper yoke 14 has an inner side 14*a* and an outer side 14*b*, and the lower yoke 16 has an inner side 16*a* and an outer side 16*b*. The upper yoke 14 comprises a stack of plates 26, while the lower yoke 16 comprises a stack of plates 28. Both the plates 26 and the plates 28 are arranged in groups. In one exemplary embodiment of the present invention, the groups are groups of seven. Of course, groups of different numbers may be used, such as groups of four, which are used herein for ease of description and illustration. Each of the plates 26, 28 is composed of grain-oriented silicon steel and has a thickness in a range of from about 7 mils to about 14 mils, with the particular thickness being selected based on the application of the transformer 10. The plates 26, 28 each have a unitary construction and are trapezoidal in shape. In each of the plates 26, 28, opposing ends of the plate 26, 28 are mitered at oppositely-directed angles of about 45°; thereby providing the plate 26, 28 with major and minor sides. The plates 26 have the same width to provide the upper yoke 14 with a rectangular cross-section and the plates 28 have the same width to provide the lower yoke 16 with a rectangular cross-section. However, the lengths of the plates 26 are not all the same and the lengths of the plates 28 are not all the same. More specifically, the lengths within each group of plates 26 are different and the lengths within each group of plates 28 are different. The pattern of different lengths is the same for each group of plates 26 and the pattern of different lengths is the same for each group of plates 28. The difference in lengths within each group permits the formation of multi-step lap joints with plates 30, 32 of the first and second outer legs 18, 20 as will be described more fully below.

A V-shaped upper notch 34 is formed in each of the plates 26 of the upper yoke 14 by an upper interior edge 36 and a V-shaped lower notch 38 is formed in each of the plates 28 of the lower yoke 16 by a lower interior edge 40. The upper interior edges 36 in adjacent plates 26 of the upper yoke 14 have different depths for forming vertical lap joints with upper ends of inner leg plates 70 of the inner leg 22, as will be described more fully below. Similarly, the lower interior edges 40 in adjacent plates 28 of the lower yoke 16 have different depths for forming vertical lap joints with lower ends of the inner leg plates 70 of the inner leg 22, as will be described more fully below. The upper notches 34 form an upper groove 46 in the upper yoke 14, while the lower notches 38 form a lower groove 48 in the lower yoke 14. The upper groove 46 is located inwardly from the outer side 14*b*, and the lower groove 48 is located inwardly from the outer side 16*b*. The upper and lower grooves 46, 48 extend in the stacking directions of the upper and lower yokes 14, 16, respectively.

Figure 2:
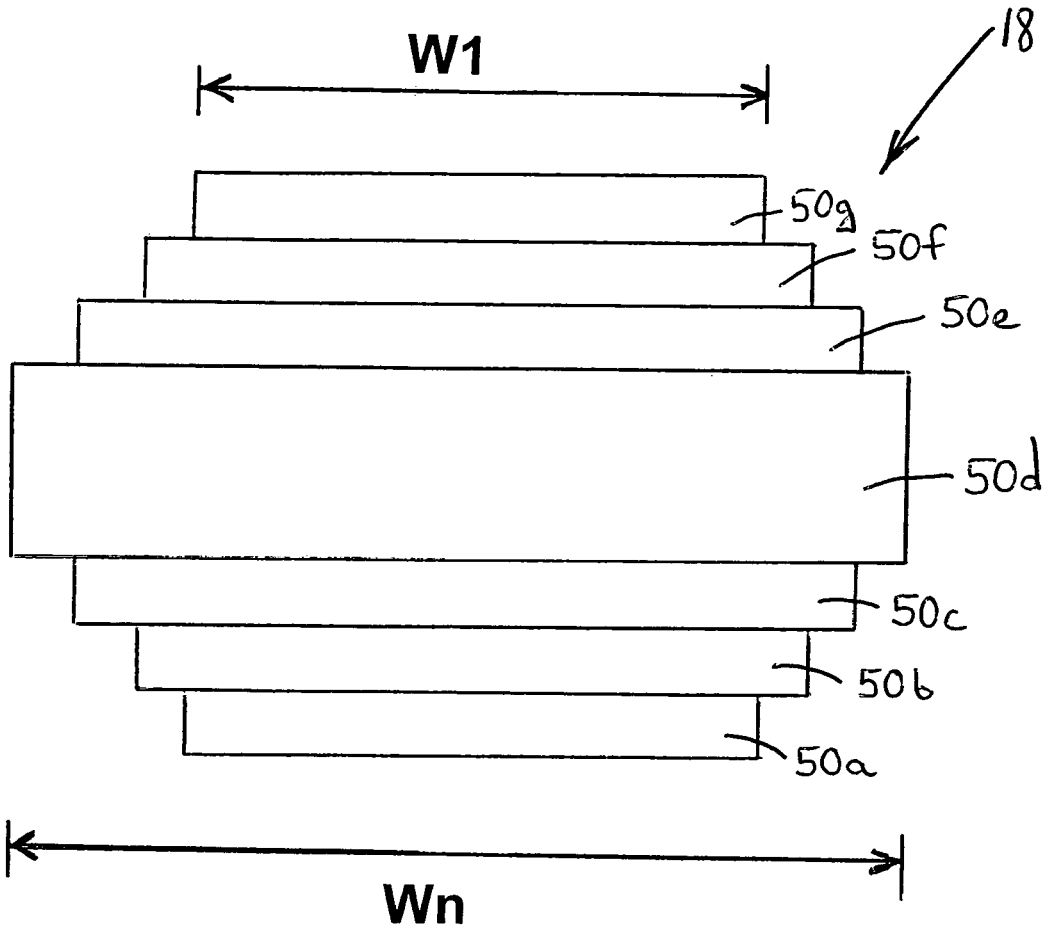
FIG. 2 shows a cross-sectional view of a first outer leg of the transformer core.

The first outer leg 18 comprises a stack of the plates 30, while the second outer leg 20 comprises a stack of the plates 32. The plates 30, 32 have varying widths so as to provide the first and second outer legs 18, 20 with cruciform cross-sections. More specifically, the plates 30 are arranged in sections 50 of different widths and the plates 32 are arranged in sections 52 of different widths. In each section 50, the plates 30 have the same width and in each section 52, the plates 32 have the same width. For example, and with reference now to FIG. 2, the first outer leg 18 has sections 50*a,b,c,d,e,f,g* of the plates 30 that in a forward to rearward direction, first successively increase in width and, then after the midpoint, successively decrease in width. The sections 50*a-g* each comprise one or more groups of plates 30. Thus, the outermost plates 30 in sections 50*a* and 50*g* each have a width W1, which is the smallest of the widths of the plates 30, and the plates 30 in the middle section 50*d* each have a width Wn, which is the largest of the widths of the plates 30. The thickness of the sections 50*a-g* in the stacking direction may vary. For example, as shown, the center section 50*d* may be substantially thicker than the other sections 50*a,b,c,e,f,g*. Although not shown, it should be appreciated that the sections 52 of the second outer leg 20 have the same arrangement as the sections 50 of the first outer leg 18.

Within each section 50, 52, the plates 30, 32 are arranged in groups of the same number as the plates 26, 28. Each of the plates 30, 32 is composed of grain-oriented silicon steel and has a thickness in a range of from about 7 mils to about 14 mils, with the particular thickness being selected based on the application of the transformer. The plates 30, 32 each have a unitary construction and are trapezoidal in shape. In each of the plates 30, 32, opposing ends of the plate 30, 32 are mitered at oppositely-directed angles of about 45°, thereby providing the plate 30, 32 with major and minor side edges. The lengths of the plates 30 are not all the same and the lengths of the plates 32 are not all the same. More specifically, the lengths within each group of plates 30 are different and the lengths within each group of plates 32 are different. The pattern of different lengths is the same for each group of plates 30 and the pattern of different lengths is the same for each group of plates 32. The difference in lengths within each group permits the formation of the multi-step joints with the plates 28 of the first and second outer legs 18,20, as will be described more fully below.

Figure 3:
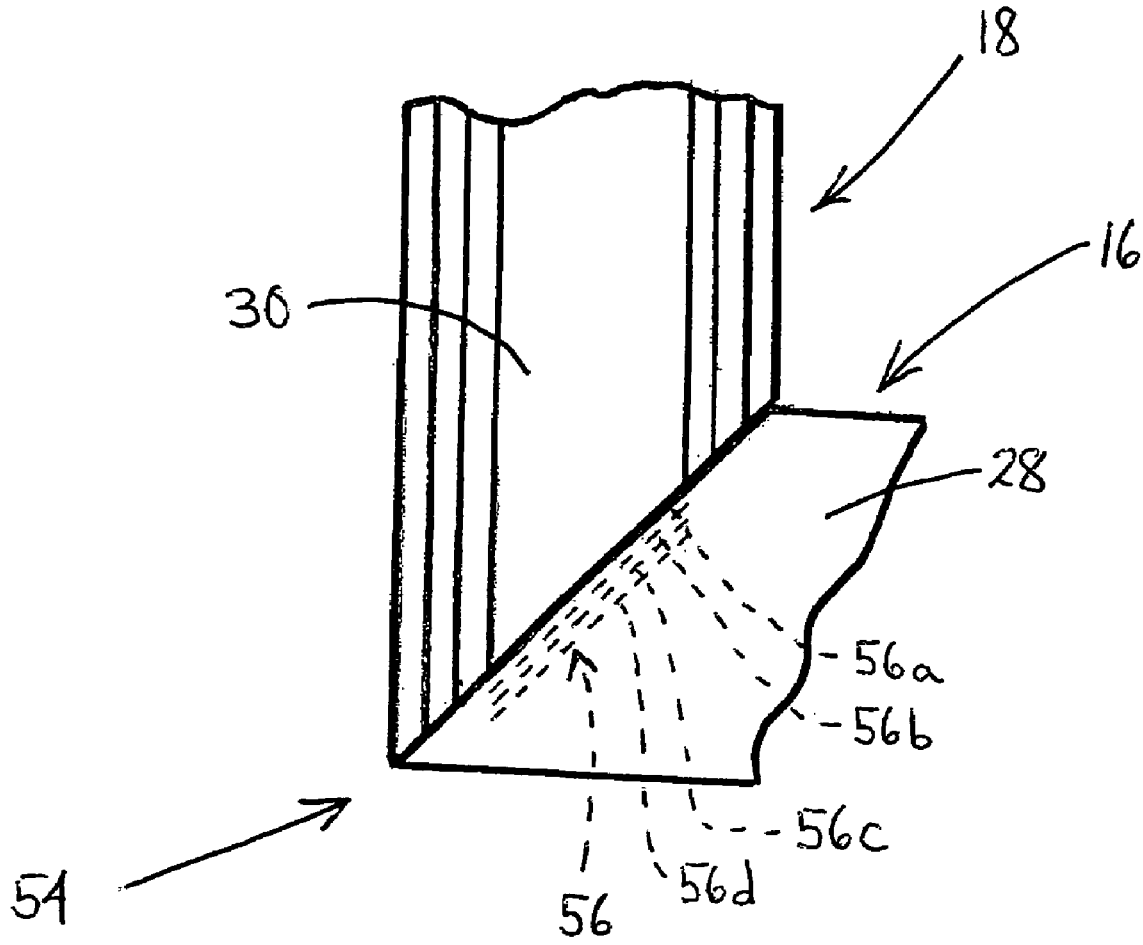
FIG. 3 shows a close-up view of a connection between the first outer leg and a lower yoke of the transformer core.

Referring now to FIG. 3 there is shown an enlarged view of the connection (represented by reference number 54) between the lower end of the first outer leg 18 and the first end of the lower yoke 16. The ends of the plates 30 form multi-step lap joints 56 with the ends of the plates 28 of the lower yoke 16. For example, and with reference now also to FIG. 5, first through fourth plates 30*a-d* of the section 50*a* of the first outer leg 18 form joints 56*a-d* with first through fourth plates 28*a-d* of the lower yoke 16. Since the plates 30*a-d* in the first section 50*a* are narrower than the plates 28*a-d*, the joints 56*a-d* do not extend the entire length of the mitered ends of the plates 28*a-d*, as is shown. The first through fourth plates 30*a-d* of the first outer leg 18 and the first through fourth plates 28*a-d* of the lower yoke 16 are located successively inward. The first through fourth plates 30*a-d* of the first outer leg 18 have successively longer lengths, whereas the first through fourth plates 28*a-d* of the lower yoke 16 have successively shorter lengths. With this construction, the first plate 28*a* overlaps the joint 56*b* between the second plates 28*b*, 30*b*, the second plate 28*b* overlaps the joint 56*c* between the third plates 28*c*, 30*c* and the third plate 28*c* overlaps the joint 56*d* between the fourth plates 28*d*, 30*d*. Although not shown, this pattern is repeated for the other groups of plates 30 in the first outer leg 18 and the corresponding other groups of plates 28 in the lower yoke 16. In this manner, the joints 56 that are formed between the plates 28 of the lower yoke 16 and the plates 30 of the first outer leg 18 are multi-step lap joints, with plates 28 of the lower yoke 16 overlapping plates 30 of the first outer leg 18, respectively.

The other connections (represented by reference numerals 58, 60, 62) between the first and second outer legs 18, 20 and the upper and lower yokes 14, 16 are constructed in the same manner as the connection 54 so as to have multi-step lap joints. It should be appreciated, however, that the connections 54, 58, 60, 62 may have a different type of construction. For example, instead of the connections 54, 58, 60, 62 having a four step lap joint pattern, the connections 54, 58, 60, 62 may have a seven, or other number step lap joint pattern. In addition, instead of having plates 26, 28 of the upper and lower yokes 14,16 overlapping plates 30, 32 of the first and second outer legs 18, 20, plates 30, 32 of the first and second outer legs 18, 20 may overlap plates 26, 28 of the upper and lower yokes 14, 16.

Figure 4:
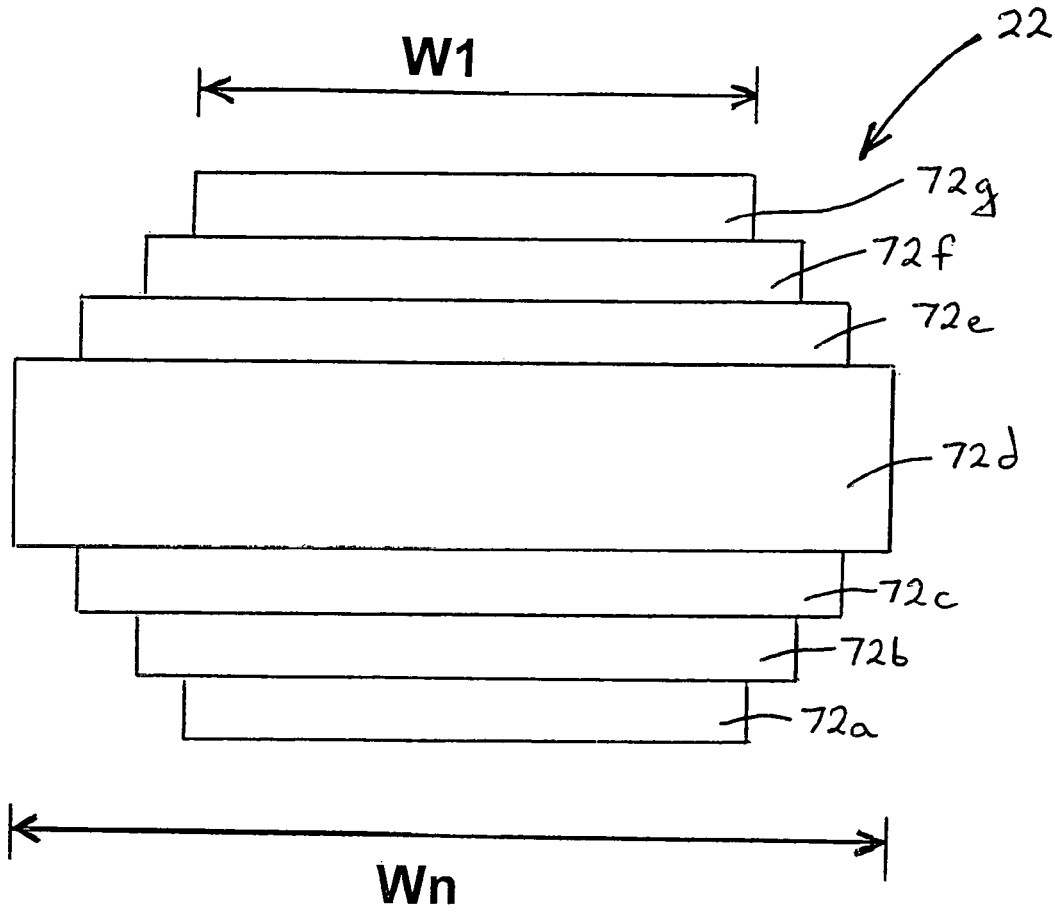
FIG. 4 shows a cross-sectional view of an inner leg of the transformer core.

The inner leg 22 comprises a stack of inner leg plates 70. The inner leg plates 70 have varying widths so as to provide the inner leg 22 with a cruciform cross-section. More specifically, the inner leg plates 70 are arranged in sections 72 of different widths, wherein in each section 72, the inner leg plates 70 have the same width. This is best illustrated in FIG. 4, which shows the inner leg 22 having sections 72*a,b,c,d,e,f,g* of the inner leg plates 70 that in a forward to rearward direction, first successively increase in width and, then after the midpoint, successively decrease in width. The sections 72*a-g* each comprise one or more groups of inner leg plates 70. Thus, the outermost inner leg plates 70 in sections 72*a* and 72*g* each have a width W1, which is the smallest of the widths of the inner leg plates 70, and the inner leg plates 70 in the middle section 72*d* each have a width Wn, which is the largest of the widths of the inner leg plates 70. As with the first and second outer legs 18, 20, the thickness of the sections 72*a-g* in the stacking direction may vary. For example, as shown, the center section 72*d* may be substantially thicker than the other sections 72*a,b,c,e,f,g*.

Within each section 72, the inner leg plates 70 are arranged in groups of the same number as the plates 26, 28 (e.g. four). Each of the inner leg plates 70 is composed of grain-oriented silicon steel and has a thickness in a range of from about 7 mils to about 14 mils, with the particular thickness being selected based on the application of the transformer 10. The inner leg plates 70 each have a unitary construction and include upper and lower pointed or tined ends, wherein each of the upper and lower tined ends is formed by a pair of miter cuts of about 45° each. The inner leg plates 70 may all have the same length if the joints are offset by vertically shifting the inner leg plates 70. Alternately, the inner leg plates 70 may have a plurality of different lengths if the joints are offset by the different lengths of adjacent inner leg plates 70.

Figure 5:
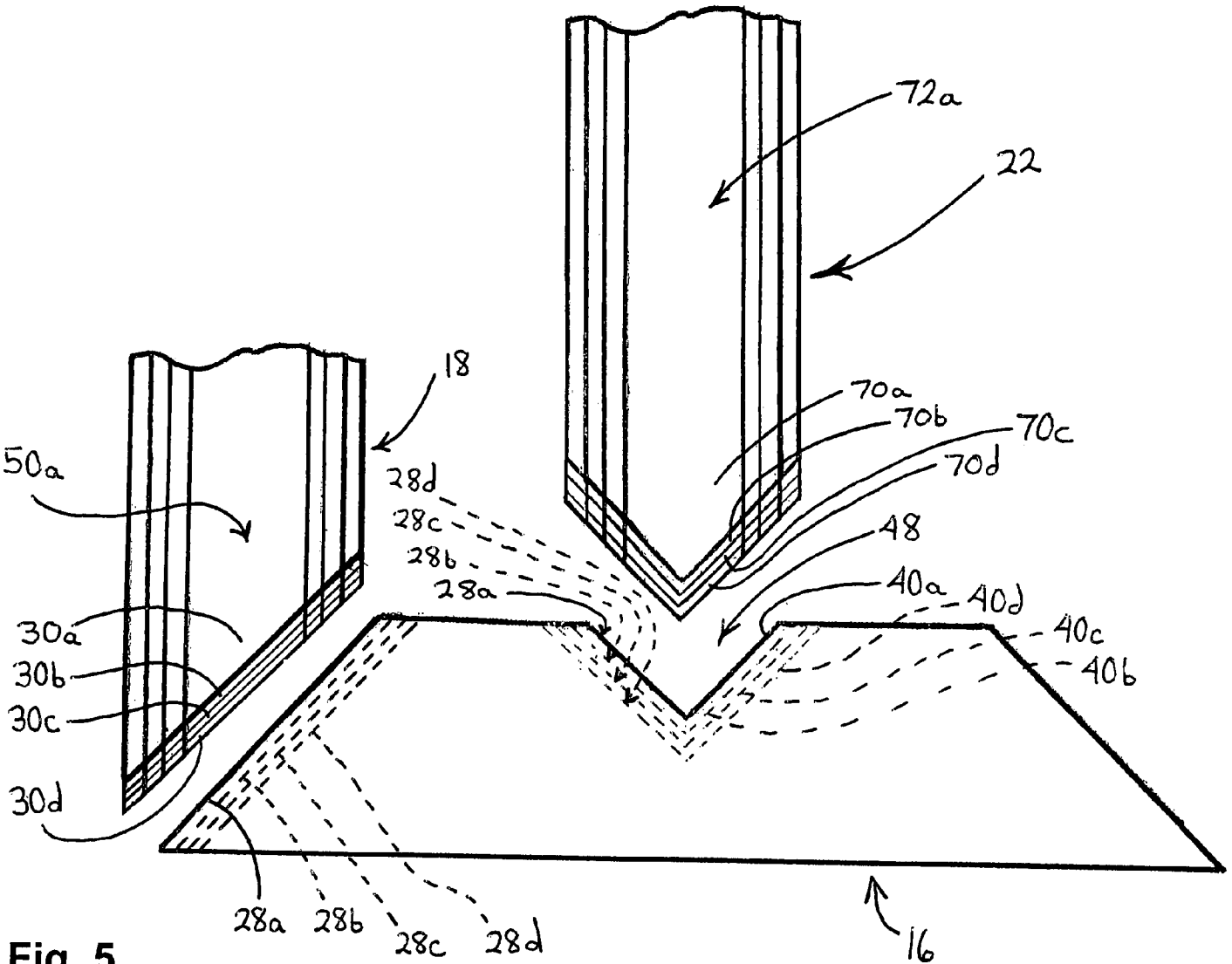
FIG. 5 shows an enlarged view of a portion of the first outer leg and the inner leg spaced above the lower yoke of the transformer core.

Referring now to FIG. 5, when the lower end of the inner leg 22 is disposed in the lower groove 48, the ends of first, second, third and fourth inner leg plates 70*a, b, c, d* of section 72*a* abut (form joints with) the lower interior edges 40*a,b,c,d* of the first, second, third and fourth plates 28*a, b, c, d* of the lower yoke 16, respectively. The first through fourth inner leg plates 70*a-d* are vertically offset such that lower ends thereof are located successively farther downward. In order to accommodate these differences in length, the lower interior edges 40*a,b,c,d* of the plates 28*a-d* are cut successively deeper. With this construction, the first plate 28*a* overlaps the joint between the second inner leg plate 70*b* and the second plate 28*b*, the second plate 28*b* overlaps the joint between the third inner leg plate 70*c* and the third plate 28*c*, and the third plate 28*c* overlaps the joint between the fourth inner leg plate 70*d* and the fourth plate 28*d*. Although not shown, this pattern is repeated for the other groups of inner leg plates 70 in the inner leg 22 and the corresponding other groups of plates 28 in the lower yoke 16. In this manner, vertical multi-step lap joints are formed between the plates 28 of the lower yoke 16 and the inner leg plates 70 of the inner leg 22, with plates 28 of the lower yoke 16 overlapping plates 70 of the inner leg 22.

Since the lower ends of the first through fourth inner leg plates 70*a-d* of the inner leg 22 are located successively farther downward, upper ends of the first through fourth inner leg plates 70*a,b,c,d* of the inner leg 22 are located successively farther downward. As a result, the upper interior edges 36 (and, thus, the upper notches 34) of the plates 26 within each group are successively shallower, which is the inverse of the lower yoke 16. With this construction, vertical multi-step lap joints are formed between the plates 26 of the upper yoke 14 and the inner leg plates 70 of the inner leg 22, with inner leg plates 70 overlapping plates 26 of the upper yoke 14.

It should be appreciated that the inner leg plates 70 of the inner leg 22 may be offset differently so as to have plates 26 of the upper yoke 14 overlapping inner leg plates 70 and inner leg plates 70 overlapping plates 28 of the lower yoke 16. In addition, the inner leg plates 70 may be offset to form a seven or other number step lap joint pattern, instead of the four step lap joint pattern.

In the embodiment where the inner leg plates 70 have different lengths, vertical multi-step lap joints are formed between the plates 26, 28 of the upper and lower yokes 14, 16 in a manner similar to that described above, however, the upper interior edges 36 (and thus the upper notches 34) of the plates 26 of the upper yoke 14 may have the same arrangement as the lower interior edges 40 (and thus the lower notches 38) of the plates 28 of the lower yoke 16 with regard to depth, because there is no vertical shifting of the inner leg plates 70.

Figure 6:
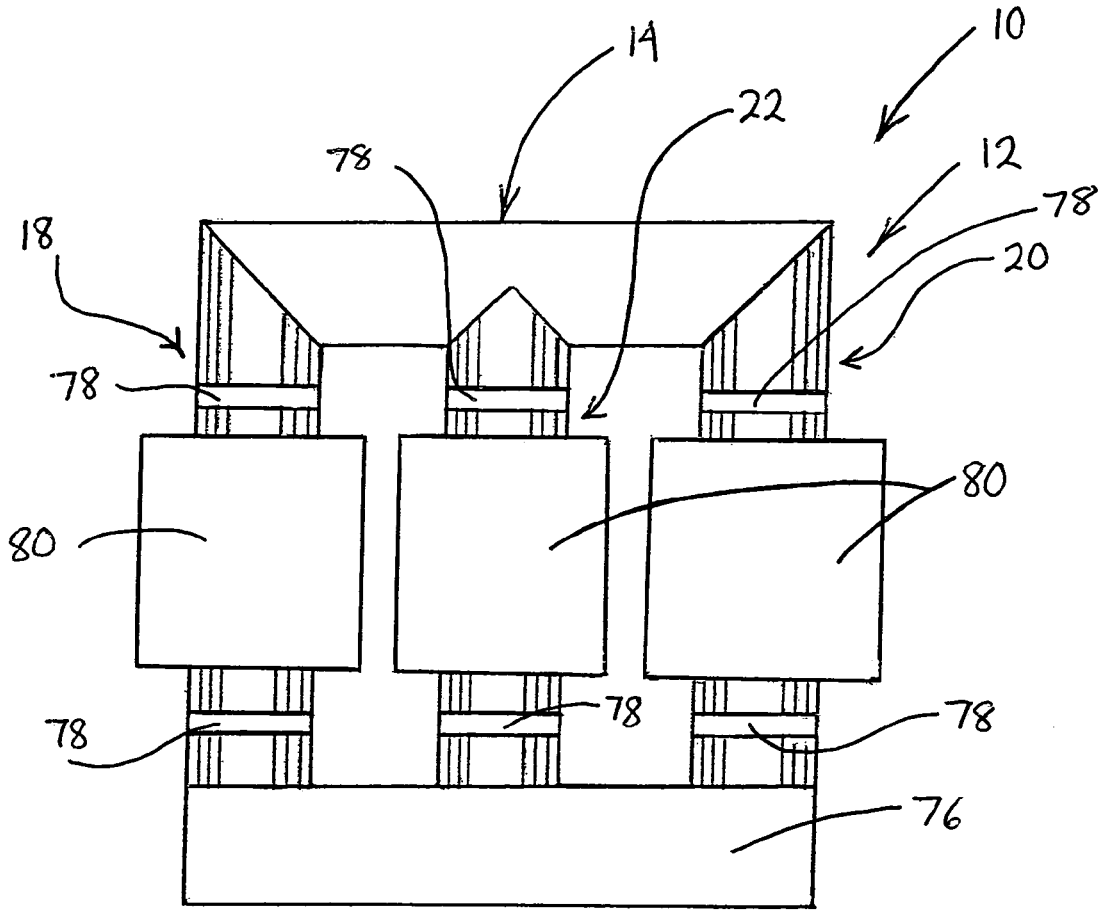
FIG. 6 shows a front elevational view of a transformer with the transformer core.

The method of assembling the core 12 is dependent on the size of the core 12. If the core 12 is large, such as would be the case if the transformer 10 was greater than 3000 kva, the core 12 is assembled with the lower yoke 16, the inner leg 22 and the first and second outer legs 18, 20 initially being disposed horizontally, i.e., the lower yoke 16, the inner leg 22 and the first and second outer legs 18, 20 are stacked in a vertical direction. In such a case the core 12 is assembled on a mounting fixture in a plurality of layers. In a first layer, a group of plates 28 is laid on the mounting fixture, with the major side disposed outwardly. Next, a group of plates 30 and a group of plates 32 are laid on the mounting fixture, with their major sides disposed outwardly and their ends abutting the ends of the group of plates 28, respectively, to form multi-step lap joints. A group of offset inner leg plates 70 are then laid on the mounting fixture, with the tined lower ends of the inner leg plates 70 abutting the lower interior edges 40 of the plates 28, respectively, to form multi-step vertical lap joints. This laying process is repeated for each layer until a desired stacking configuration is achieved. Once the lower yoke 16, the inner leg 22 and the first and second outer legs 18, 20 have been formed, the lower yoke 16 is clamped between a pair of end frames or supports 76 and bands 78 are disposed around the inner leg 22 and the first and second outer legs 18, 20, respectively, as shown in FIG. 6. The partially formed core 12 is then moved to an upright position so that the inner leg 22 and the first and second outer legs 18, 20 extend vertically. Coil windings 80 are then disposed over the inner leg 22 and the first and second outer legs 18, 20, respectively. The upper yoke 14 is then stacked in groups of plates 26 onto the ends of the inner leg 22 and the first and second outer legs 18, 20.

If the core 12 is smaller, such as would be the case if the transformer 10 was less than 3000 kva, the core 12 is assembled in a similar manner as described above, except the core 12 is formed while being disposed vertically, i.e., the components of the core 12 are stacked in a horizontal direction.

After the core 12 with the coil windings 80 is fully constructed, the core 12 is enclosed within a housing (not shown). If the transformer 10 is an oil-filled type of transformer, the core 12 is immersed in oil within a compartment in the housing. If the transformer 10 is a dry-type of transformer, the core 12 is not immersed in oil and the housing is provided with louvers to permit air to enter the housing and pass over the core 12.

Although the assembly of the core 12 set forth above describes three coil windings 80 being mounted to the core 12, such as occurs when the transformer 10 is a three-phase transformer, it should be appreciated that in another embodiment, a single coil winding 80 may be mounted to the inner leg 22 of the core 12, such as occurs when the transformer 10 is a single phase transformer.

Figure 7:
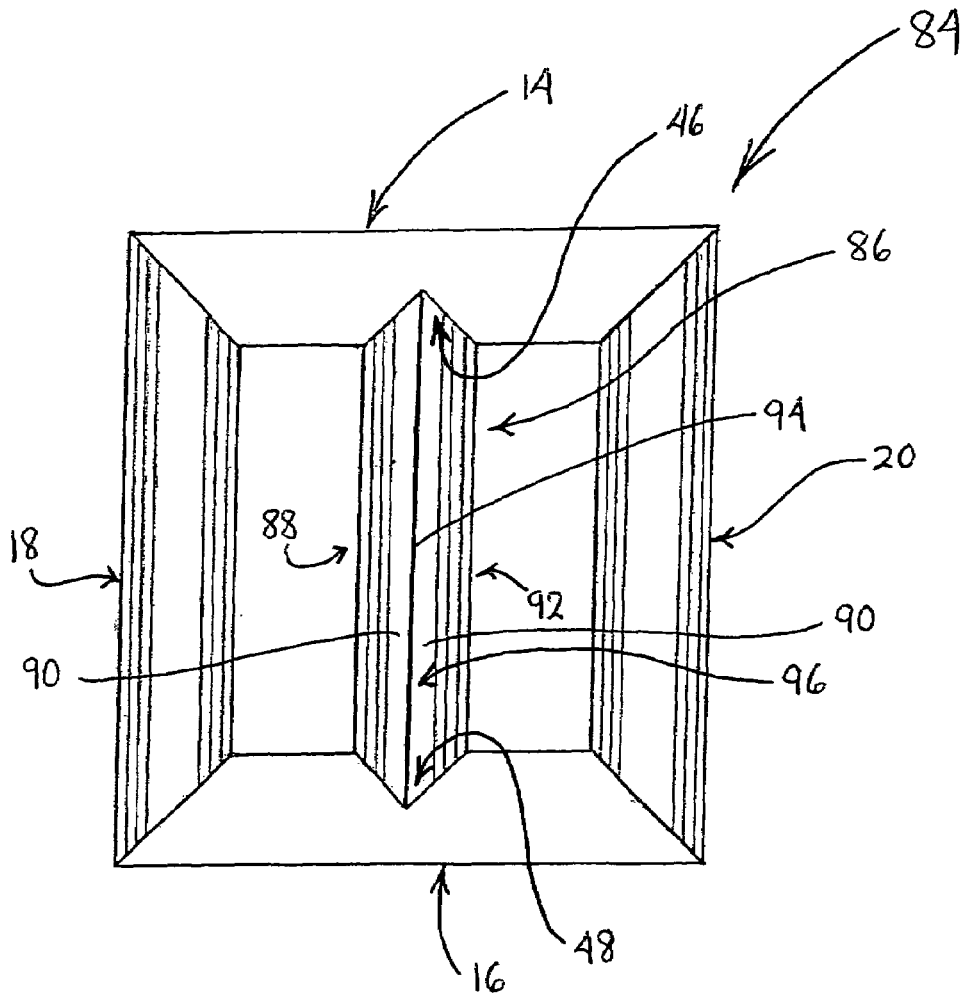
FIG. 7 shows a front elevational view of a second transformer core embodied in accordance with a second embodiment of the present invention.

Referring now to FIG. 7, there is shown a core 84 embodied in accordance with a second embodiment of the present invention. The core 84 has substantially the same construction, is constructed in substantially the same manner and may be used in a transformer in substantially the same manner as the core 12, except for the differences set forth below. Instead of having the inner leg 22, the core 84 has an inner leg 86, which comprises a first stack 88 of inner leg plates 90 and a second stack 92 of inner leg plates 90. The first and second stacks 88, 92 abut each other along a seam 94 that extends in the longitudinal direction of the inner leg 86. Upper ends of the first and second stacks 88, 92 are disposed in the upper groove 46 of the upper yoke 14 and lower ends of the first and second stacks 88, 92 are disposed in the lower groove 48 of the lower yoke 16. Each of the inner leg plates 90 has a unitary construction and is trapezoidal in shape. In each of the inner leg plates 90, opposing ends of the inner leg plate 90 are mitered at oppositely-directed angles of about 45°, thereby providing the inner leg plate 90 with major and minor side edges. In each layer of the inner leg 86, a major side edge of an inner leg plate 90 of the first stack 88 abuts a major side edge of an inner leg plate 90 of the second stack 92. With this orientation, the two mitered ends of the abutting inner leg plates 90 at each end of the layer cooperate to provide the end of the layer with a pointed or tined configuration.

The inner leg plates 90 have varying widths so as to provide the inner leg 86 with a cruciform cross-section. More specifically, the inner leg plates 90 are arranged in sections 96 of different widths, wherein each section 96 comprises a portion of the first stack 88 and an adjacent portion of the second stack 92. The inner leg plates 90 in each section 96 have the same width. In each of the first and second stacks 88, 92, the major side edges of the inner leg plates 90 are aligned at the seam 94. The different widths, however, cause the minor sides to be offset, which helps form the cruciform cross-section of the inner leg 86.

The inner leg plates 90 in each section 96 may be cut from the same roll of metal in the manner described in co-pending U.S. patent application Ser. No. 11/093,551, filed on the same date herewith and entitled "A TRANSFORMER HAVING A STACKED CORE WITH A SPLIT LEG AND A METHOD OF MAKING THE SAME", which is assigned to the assignee of the present invention and is hereby incorporated by reference.

Figure 8:
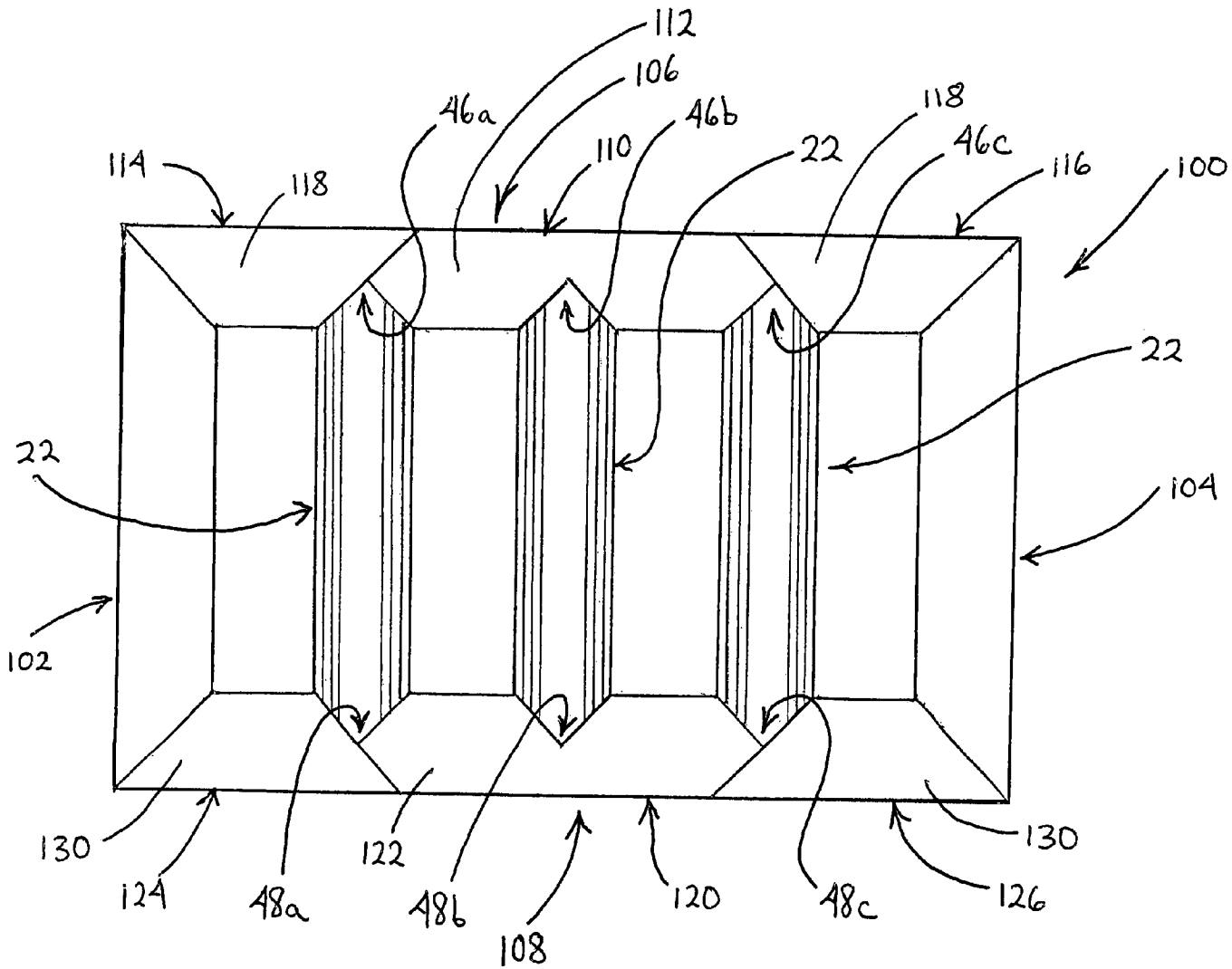
FIG. 8 shows a front elevational view of a third transformer core embodied in accordance with a third embodiment of the present invention.

Referring now to FIG. 8, there is shown a core 100 embodied in accordance with a third embodiment of the present invention. The core 100 has substantially the same construction, is constructed in substantially the same manner and may be used in a transformer in substantially the same manner as the core 12, except for the differences set forth below. Instead of having only one inner leg 22, like the core 12, the core 100 has three inner legs 22. In addition, the core 100 has first and second outer legs 102, 104 with rectangular cross-sections, instead of cruciform cross-sections, as in the core 12. Also, the core 100 has upper and lower yokes 106, 108, each of which is comprised of a plurality of stacks of plates, instead of only a single stack, as in the core 12. Further, the upper yoke 106 of the core 100 has three upper grooves 46*a, b, c* and the lower yoke 108 of the core 100 has three lower grooves 48*a, b, c,* instead of a single upper groove 46 and a single lower groove 48, as in the core 12. With the construction described above, the coil windings 80 are mounted to the three inner legs 22 of the core 100, respectively.

The upper yoke 106 comprises a center stack 110 of plates 112 and first and second outer stacks 114, 116 of plates 118. Similarly, the lower yoke 108 comprises a center stack 120 of plates 122 and first and second outer stacks 124, 126 of plates 130. Each of the plates 112, 122 is elongated and has opposing tined ends. Each of the plates 118, 130 is trapezoidal in shape and has opposing ends mitered at oppositely-directed angles of about 45°. In the upper yoke 106, an inner end of the first outer stack 114 cooperates with a first end of the center stack 110 to define the upper groove 46*a,* while an inner end of the second outer stack 116 cooperates with a second end of the center stack 110 to define the upper groove 46*c*. Similarly, in the lower yoke 108, an inner end of the first outer stack 124 cooperates with a first end of the center stack 120 to define the lower groove 48*a,* while an inner end of the second outer stack 126 cooperates with a second end of the center stack 120 to define the lower groove 48*c*. The upper groove 46*b* is formed in the center stack 110, and the lower groove 48*b* is formed in the center stack 120.

In the upper yoke 106, the first and second outer stacks 114, 116 may simply abut the center stack 110, i.e., form seams with the center stack 110, or the plates 118 of the first and second outer stacks 114, 116 may form multi-step lap joints with the plates 112 of the center stack 110. Similarly, in the lower yoke 108, the first and second outer stacks 124, 126 may simply abut the center stack 120, i.e., form seams with the center stack 120, or the plates 130 of the first and second outer stacks 124, 126 may form multi-step lap joints With the plates 122 of the center stack 120.

A transformer core embodied in accordance with the present invention provide a number of benefits over conventional transformer cores. For example, providing the transformer core with legs having cruciform cross-sections increases the strength of the core and provides the legs with larger surface areas for supporting coil windings, while providing the transformer core with yokes having rectangular cross-sections simplifies the construction of the yokes (and, thus, the core) and reduces the amount of metal wasted in constructing the yokes (and, thus, the core).

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A transformer comprising:

(a.) a core comprising:

a first yoke comprising a stack of plates and having an outer side and an inner side with a groove formed therein, said groove extending in a stacking direction of the plates and being located inwardly from the outer side, said plates having the same width so as to provide the first yoke with a rectangular cross-section;

a second yoke comprising a stack of plates and having an outer side and an inner side with a groove formed therein, said groove extending in the stacking direction of the plates and being located inwardly from the outer side;

an inner leg having a first end disposed in the groove of the first yoke and a second end disposed in the groove of the second yoke, said inner leg having a cruciform cross-section and comprising a stack of plates with different widths; and (b.) a coil winding mounted to the inner leg.

2. The transformer of claim 1, wherein the core further comprises first and second outer legs extending between the first and second yokes, said first and second outer legs each comprising a stack of plates; and wherein the inner leg is disposed between the first and second outer legs.

3. The transformer of claim 2, wherein the plates of the second yoke have the same width so as to provide the second yoke with a rectangular cross-section.

4. The transformer of claim 3, wherein the plates of the first outer leg have different widths so as to provide the first outer leg with a cruciform cross-section, and wherein the plates of the second outer leg have different widths so as to provide the second outer leg with a cruciform cross-section.

5. The transformer of claim 4, wherein the coil winding is a first coil winding, and wherein the transformer further comprises second and third coil windings mounted to the first and second outer legs, respectively.

6. The transformer of claim 4, wherein each of the plates of the first and second outer legs have opposing mitered ends, and each of the plates of the first and second yokes have opposing mitered ends;

wherein the mitered ends of the plates of the first outer leg form multi-step lap joints with the mitered ends of the plates of the first and second yokes; and wherein the mitered ends of the plates of the second outer leg form multi-step lap joints with the mitered ends of the plates of the first and second yokes.

7. The transformer of claim 6, wherein each of the plates of the first and second yokes is unitary.

8. The transformer of claim 3, further comprising second and third inner legs extending between the first and second yokes, said second and third inner legs each comprising a stack of plates.

9. The transformer of claim 8, wherein the stack of plates of the first yoke is a first stack, and wherein the first yoke further comprises a second stack of plates and a third stack of plates, said first, second and third stacks being collocated in the direction between the first and second outer legs; and wherein the stack of plates of the second yoke is a first stack, and wherein the second yoke further comprises a second stack of plates and a third stack of plates, said first, second and third stacks being collocated in the direction between the first and second outer legs.

10. The transformer of claim 8, wherein the plates of the second inner leg have different widths so as to provide the second inner leg with a cruciform cross-section, and wherein the plates of the third inner leg have different widths so as to provide the third inner leg with a cruciform cross-section.

11. The transformer of claim 10, wherein the coil winding is a first coil winding, and wherein the transformer further comprises second and third coil windings mounted to the second and third inner legs, respectively.

12. The transformer of claim 1, wherein the stack of plates of the inner leg is a first stack of plates and the inner leg further comprises a second stack of plates, and wherein the first stack abuts the second stack along a seam extending in the longitudinal direction of the inner leg.

13. The transformer of claim 1, wherein each of the plates of the first yoke has a V-shaped notch defined by an inner edge, said notches forming the groove of the first yoke;

wherein first ends of the plates of the inner leg form the first end of the inner leg; and wherein the first ends of the plates of the inner leg form vertical multi-step lap joints with the inner edges of the first yoke.

14. The transformer of claim 1, wherein the plates of the inner leg are arranged in sections of different widths, wherein the plates in each section have the same width.

15. The transformer of claim 1, wherein the transformer is a dry-type transformer.

16. A transformer comprising:

(a.) a core comprising:

a first yoke comprising a stack of plates having the same width so as to provide the first yoke with a rectangular cross-section;

a second yoke;

a leg with first and second ends and extending between the first and second yokes, the leg having a cruciform cross-section and comprising a stack of plates with different widths, wherein the plates of the leg form joints with the first yoke at the first end of the leg and the plates of the leg form joints with the second yoke at the second end of the leg; and (b.) a coil winding mounted to the leg.

17. The transformer of claim 16, wherein the second yoke comprises a stack of plates having the same width so as to provide the second yoke with a rectangular cross-section.

18. The transformer of claim 17, wherein the joints formed between the leg and the first yoke comprise multi-step lap joints and the joints formed between the leg and the second yoke comprise multi-step lap joints.

19. The transformer of claim 17, wherein the leg is a first leg and the transformer further comprises a second leg and a third leg extending between the first and second yokes, the second leg and the third leg each having a cruciform cross-section and comprising a stack of plates with different widths.

20. The transformer of claim 19, wherein the first leg is disposed between the second and third legs.

* * * * *